US005605291A

United States Patent [19]

Doskocil

[11] Patent Number: 5,605,291

[45] Date of Patent: Feb. 25, 1997

[54] CHIPPER/MULCHER

[76] Inventor: David Doskocil, 1324 W. Rialto, San Bernardino, Calif. 92410

[21] Appl. No.: 234,055

[22] Filed: Apr. 28, 1994

[51] Int. Cl.[6] ..... B02C 13/04

[52] U.S. Cl. ..... 241/55; 241/73; 241/194

[58] Field of Search ..... 241/55, 73, 92, 241/194; 144/163, 176

[56] References Cited

U.S. PATENT DOCUMENTS

| | | | |
|---|---|---|---|
| Re. 17,120 | 10/1928 | Keith . | |
| 989,271 | 4/1911 | Lombard . | |
| 1,185,620 | 6/1916 | Blum . | |
| 1,713,094 | 5/1929 | Saiberlich et al. . | |
| 1,759,905 | 5/1930 | Keith . | |
| 2,225,781 | 12/1940 | Hinerfeld | 83/6 |
| 2,435,226 | 2/1948 | Lanter | 241/86 |
| 3,384,311 | 5/1968 | Eklund et al. | 241/56 |
| 3,410,495 | 11/1968 | Eklund | 251/278 |
| 3,549,093 | 12/1970 | Pallmann | 241/49 |
| 3,635,410 | 1/1972 | Smith | 241/56 |
| 3,756,517 | 9/1973 | Hock et al. | 241/56 |
| 3,806,047 | 4/1974 | Ober | 241/188 |
| 3,856,218 | 12/1974 | Harmon et al. | 241/186 |
| 3,892,265 | 7/1975 | Vanek | 144/230 |
| 4,117,983 | 10/1978 | Browning | 241/55 |
| 4,298,044 | 11/1981 | Hansel et al. | 144/176 |
| 4,390,132 | 6/1983 | Hutson et al. | 241/55 |
| 4,503,893 | 3/1985 | Demopoulos | 144/176 |
| 4,544,105 | 10/1985 | Carlsson | 241/73 |
| 4,771,718 | 9/1988 | Carpenter et al. | 144/176 |
| 4,796,818 | 1/1989 | Thoma | 241/85 |
| 4,824,034 | 4/1989 | Baker | 241/101.2 |
| 5,042,730 | 8/1991 | Hundt | 241/73 |
| 5,102,056 | 4/1992 | Ober | 241/55 |
| 5,129,437 | 7/1992 | Nettles et al. | 144/176 |
| 5,137,219 | 8/1992 | Morey | 241/92 |
| 5,199,653 | 4/1993 | Durrant et al. | 241/73 |
| 5,199,666 | 4/1993 | Williams | 241/73 |
| 5,209,278 | 5/1993 | Carpenter et al. | 144/230 |
| 5,240,190 | 8/1993 | Johnson | 241/74 |
| 5,271,440 | 12/1993 | Bradstreet et al. | 144/176 |
| 5,273,218 | 12/1993 | Burns | 241/32 |
| 5,358,189 | 10/1994 | Vandermolen | 241/92 |

FOREIGN PATENT DOCUMENTS

| | | | |
|---|---|---|---|
| 966761 | 4/1975 | Canada | 144/163 |

*Primary Examiner*—John M. Husar
*Attorney, Agent, or Firm*—Lyon & Lyon

[57] ABSTRACT

A disc type chipper/mulcher having multi-blade flails in which two or more blades are attached to a sleeve, and the blade/sleeve combination pivots about a post as a single unit. The flails are sharpenable and reversible, and can be mounted on the same side of the disc as the knives. The chipper/mulcher may also include disc mounted fan blades and a screen for governing the size of the processed materials.

27 Claims, 4 Drawing Sheets

CHIPPER/MULCHER

BACKGROUND OF THE INVENTION

The present invention relates to the field of general maintenance.

Many industrial, commercial, and household applications require the breaking up of relatively large objects into smaller pieces. In landscaping, for example, it is often useful to reduce uprooted trees and shrubs or their trimmings to wood chips, which are then used as mulch or hauled off as waste. In the farming industry, it may be useful to shred or grind feed, manure or other materials. In the construction industry, it may be necessary to reduce waste lumber and gypsum board to relatively small chips for disposal. In other applications, roots, newspapers, aluminum, plastic, discarded house plants, general rubbish, and other materials may have to be similarly reduced to smaller pieces.

The reduction process is variously referred to as cutting, chipping, shredding, mulching or grinding, depending in part on the size of the end product. Cutting and chipping is historically accomplished by a relatively few knives mounted directly onto a rotating disc, and produces pieces ranging up to about ¾ to 1½ inches in size. Shredding, mulching and grinding are historically accomplished by a dozen or more hammers which rotate about shafts attached to the disc. Such hammers typically operate within a chamber, and continue to reduce the size of the material being worked upon until that material can escape the chamber through a screen. Shredding generates pieces ranging from about ¼ to about ¾" in size, while mulching or grinding produces pieces ranging from a fine powder to about ¼". Because of the overlap in the common usage of these terms, "cutting" and "chipping" are used interchangeably herein, and "shredding", "mulching" and "grinding" are used interchangeably herein. Additionally, all devices which perform any such reduction of materials are referred to herein by the generic name, chipper/mulcher.

In previous devices, the chipping knives are usually placed on the opposite side of the disc from the hammers. Such a configuration allows a user to either chip a material by forcing it against one side of the disc, or to mulch the material by forcing it into the chamber on the other side of the disc. One drawback to such an arrangement is that a given material cannot be chipped and mulched at the same time.

Also in the previous devices, the hammers comprise either independently pivoting plates with a long axis parallel to the direction of motion, or a row of teeth arranged along an edge of a single flat plate, and positioned normal to the direction of motion. (see U.S. Pat. No. 1,759,905). The present inventor recognized that both such configurations have several drawbacks which adversely affect performance and/or maintenance costs.

First, the hammers of both prior configurations strike the materials fed into the device with dull, flat surfaces. This may be useful for mulching and grinding, but offers relatively little assistance in cutting, chipping and shredding.

Second, the prior devices exhibit a poor trade-off with respect to maintenance costs. Independently pivoting flat plates are relatively strong along their striking axis, but are relatively thin from side to side. Because of these characteristics, individually pivoting flat plates tend to wear out at the pivot, and also tend to bend and twist about the supporting shaft. Such plates can be extremely difficult to remove and replace, at times requiring a blowtorch for their removal. Similarly, such plates tend to bend to such a degree that they cannot realistically be sharpened or reversed after removal. Turning the plate 90° and cutting a row of teeth into the plate minimizes the twisting and bending about the supporting shaft, but such teeth are necessarily thin and weak because their thickness is limited by the thickness of the plate.

SUMMARY OF THE INVENTION

The present invention is directed to a disc type chipper/mulcher having multi-blade pivoting flails arrayed about a sleeve. The flails are sharpenable and reversible, and can be mounted on the same side of the disc as the knives. The chipper/mulcher may also include disc mounted fan blades, a screen for governing the size of the processed materials, and a baffle to deflect material traveling about inside the housing.

According to the preferred embodiment, a disc has eight stationary or non-moveable posts extending from each of its two sides. A multi-blade flail is placed upon each of the posts, and is held in place with a snap ring. Each of the multi-blade flails contains three blades connected to a sleeve, such that the blades and the sleeve rotate or at least pivot about the post as a single unit. The flail preferably comprises a high alloy steel which is heat treated to a designated hardness for long life.

Such an embodiment is a significant improvement over prior art devices. A multi-blade flail comprising three blades connected to a sleeve can produce approximately three to four times the cutting force as the same number of single, non-attached hammer plates. This greatly increases the performance of the device when shredding, grinding or mulching. The multi-blade flails also tend to last much longer than independently supported single-plate hammers because there is a much greater area of contact with the supporting post. When replacement is necessary, the task can be accomplished far more easily than in prior devices because the multi-blade flails do not tend to bind about the posts. Further, the blades in multi-blade flails are two sided, with both the leading and trailing edges having a sharpenable knife edge. Switching the orientation of the sleeve on the post presents a fresh knife edge in the leading position.

Also in the preferred embodiment, the flails are mounted on the same side of the disc as the knives. This permits chipping and mulching at the same time. Collision between the flails and the knives is avoided by positioning the knives closer to the central axis of the disc than the flails, and spacing the farthest extension of the flails about two inches from the closest knife.

Also in the preferred embodiment, additional flails and two or more fans blades are attached to the opposite side of the disc from the knives. This allows a vacuum hose to be attached to the fan side of the disc for vacuuming leaves and other light weight materials into the device for mulching. Such materials are mulched by all the flails, both on the fan side of the disc and on the knife side.

BRIEF DESCRIPTION OF THE DRAWING

These and other aspects of the present invention will become better understood through a consideration of the following description taken in conjunction with the drawings in which.

DETAILED DESCRIPTION OF THE PREFERRED EMBODIMENT

Figure 1:
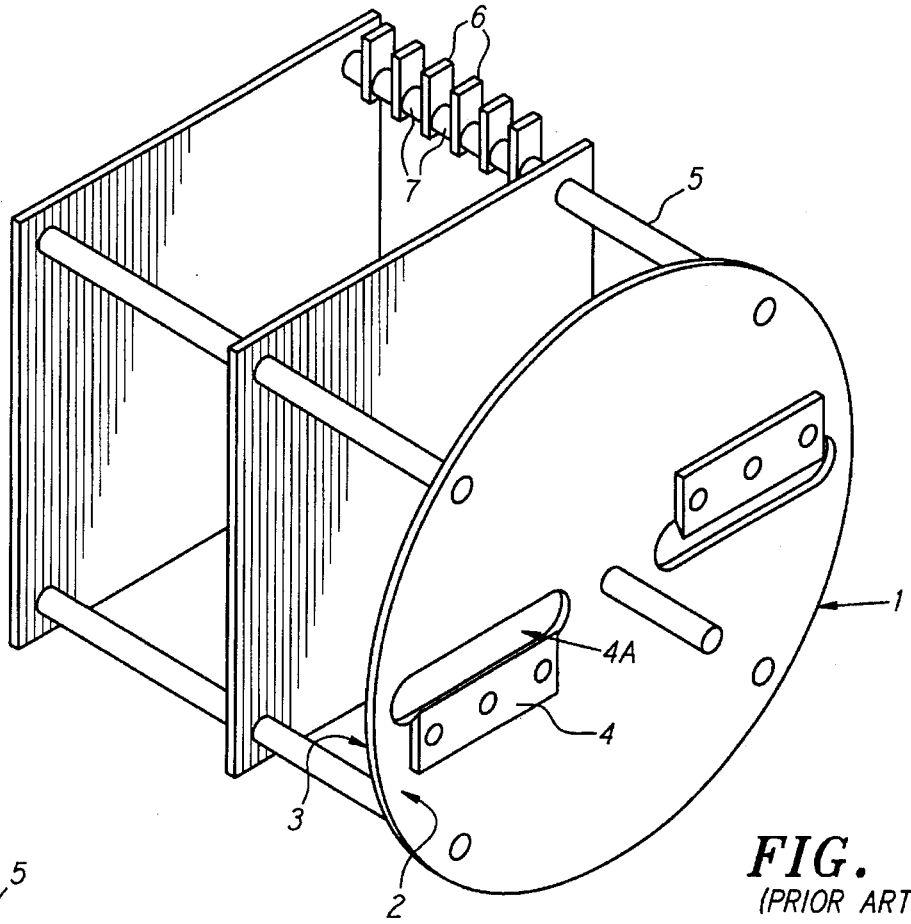
FIG. 1 (PRIOR ART)
FIG. 1 is a perspective view of a generalized prior art device.
Figure 2:
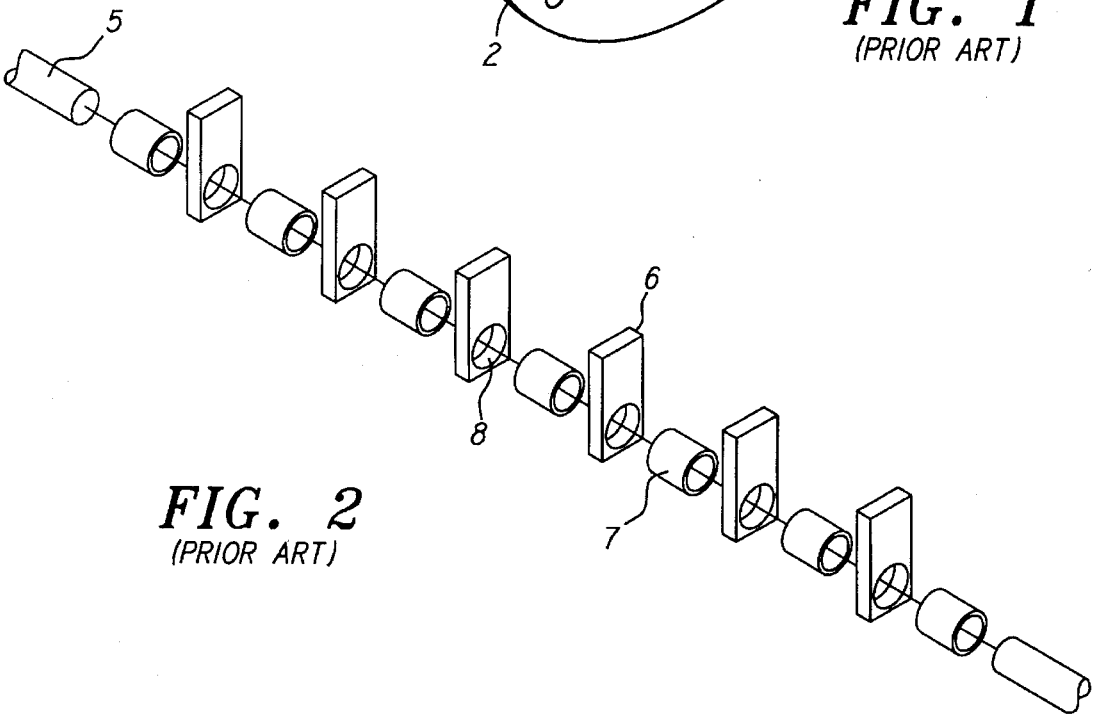
FIG. 2 (PRIOR ART)
FIG. 2 is an exploded view of the shaft and hammers of a generalized prior art device.

Turning now to the drawings, FIGS. 1 and 2 depict components of a generalized prior art device. A disc 1 has a chipping side 2 and a mulching side 3. Attached to the chipping side 2 are two knives 4 and attached to the mulching side 3 is a shaft 5 about which is positioned a series of hammer plates 6 and intervening spacers 7. Each of the plates 6 has an opening 8 for receiving shaft 5. Knife channels 4A communicate across disc 1, thereby permitting chips to pass from the chipping side 2 to the mulching side 3.

The device according to FIGS. 1 and 2 suffers from several drawbacks. The absence of plates 6 on the chipping side 2 of the disc 1 precludes simultaneous chipping and mulching of the same material at the same time. Further, as the plates 6 pivot about the shaft 5, the openings 8 tend to wear out relatively quickly, and the plates 6 tend to bend and twist, and bind against the shaft 5. Once bent or twisted, they may no longer pivot thereby reducing the reduction ability of the machine. Plates 6 may also be difficult to remove, and will almost certainly be too deformed to reverse and use a second time.

Figure 3:
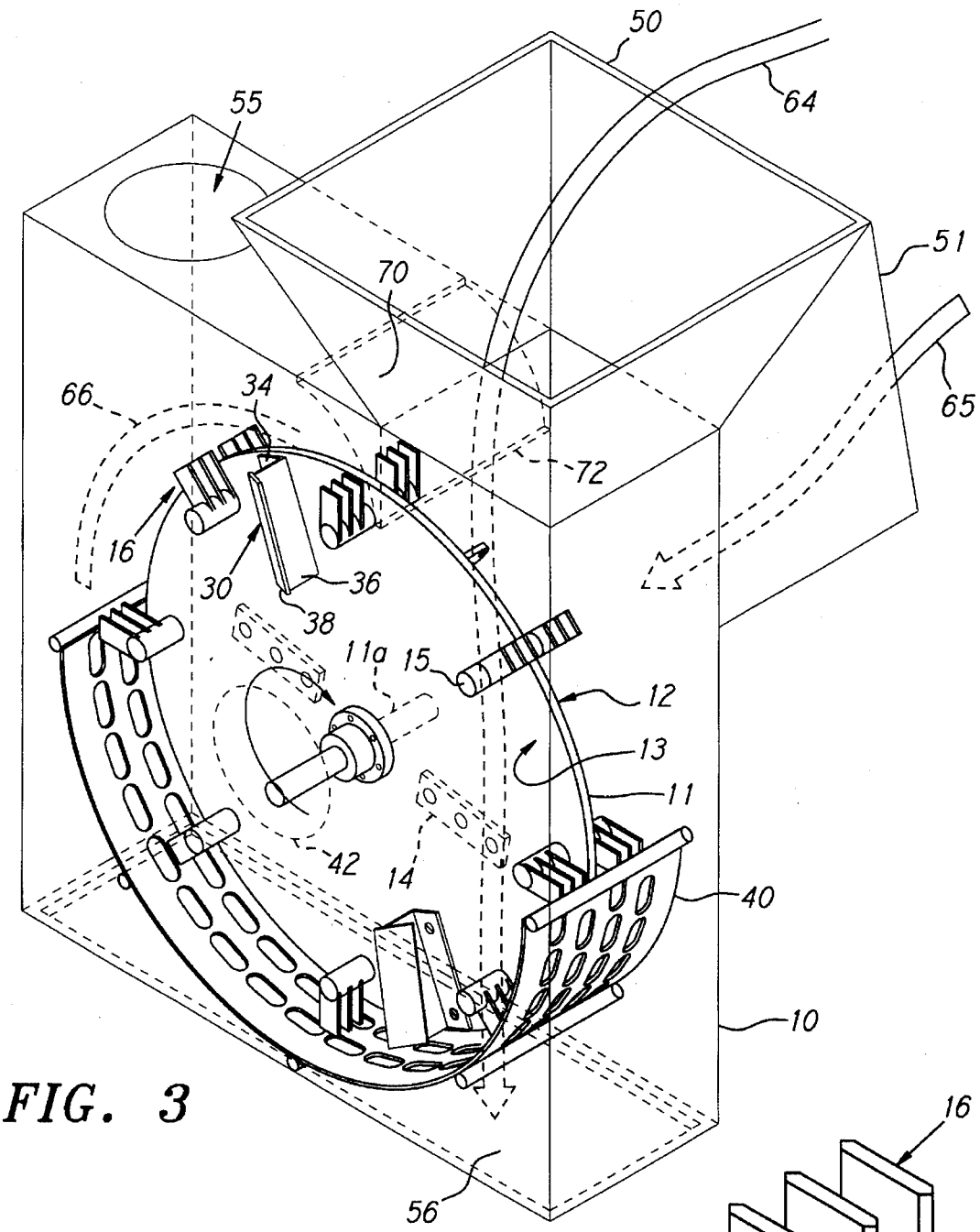
FIG. 3 is a partial cut-away perspective view of a chipper/mulcher according to the present invention.

In FIG. 3, a housing 10 contains a disc 11, knives 14, multiple flails 16, fan assemblies 30 and a screen 40. Disc 11 is about 22 inches in diameter, ¾ inches thick, comprised of A-36 steel, and is made to rotate about axle 11A at about 1600 rpm by a motor (not shown). Disc 11 has a chipping side 12 and a mulching side 13. Posts 15 are circumferentially spaced around the disc 11, and extend from both the chipping side 12 and the mulching side 13. Preferably, posts 15 on opposite sides 12, 13 of the disc 11 are paired, with each pair being the two ends of a single shaft. Posts 15 act as pivots or axes of rotation for flails 16, which are more fully described below. Since the flails 16 are attached to posts 15, and posts 15 extend from disc 11, the flails 16 are considered to be positioned on one or the other side of disc 11 even though they may not physically be touching disc 11. The knives 14 and fan assemblies 30 are similarly described more fully below. Screen 40, also known as a grate, is removable both to alter the size of the openings in screen 40, and to replace worn out screens. The size of the openings will in large measure determine the fineness to which material is reduced. FIG. 3 also depicts an opening 42 on a side wall of housing 10 for a vacuum attachment (not shown), and an opening 55 on the top wall of housing 10 for top discharging.

The flow of material being chipped and/or mulched is represented by arrows 64, 65 and 66. Arrow 64 depicts material entering the device through hopper 50 to both the chipping and mulching sides 12, 13, arrow 65 depicts material entering the device through hopper 51 to the chipping side 12, and arrow 66 depicts the flow of material in a recurrent fashion coincident with the rotation of disc 11. Hoppers 50 and 51 may also be called chutes. Baffle 70 extends downward from an an upper wall of housing 10 and serves to deflect material following the path represented by arrow 66. Baffle 70 has a bottom edge 72 which is preferably positioned approximately 15 degrees past the vertical radial line extending from the axle 11A of disc 11 such that air flow approaching the baffle 70 is deflected downwards as approximated by arrow 66. The deflection tends to draw light materials down through hopper 50, and further tends to prevent materials flowing in a recurrent fashion inside the housing 10 from being thrown back out of hopper 50 in a reverse direction to arrow 64. Baffle 70 is preferably curved, having a radius of curvature of approximately seven inches. The curvature lessens the impact of material on baffle 70, and further assists in drawing material down hopper 50.

Figure 6:
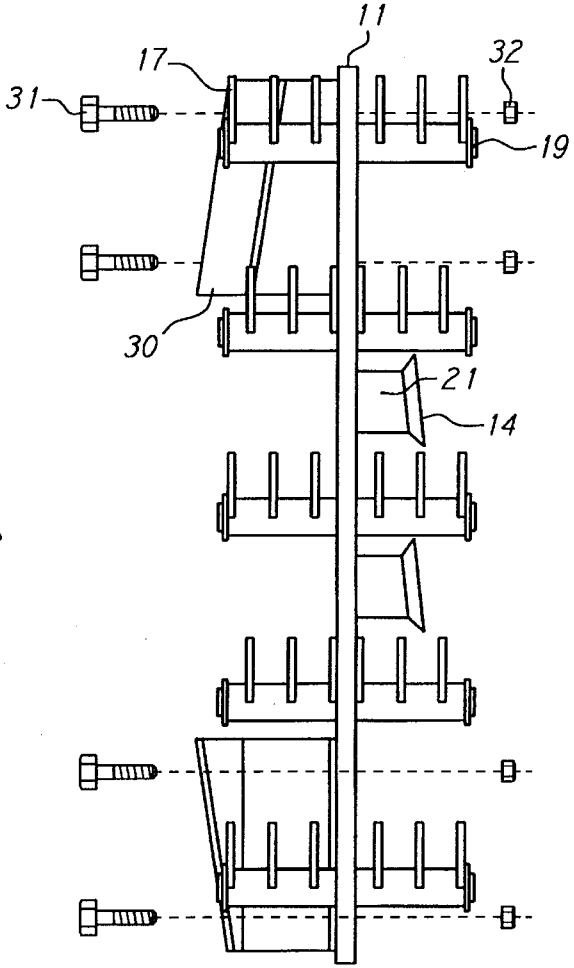
FIG. 6 is an end view of the disc of FIG. 3.
Figure 8:
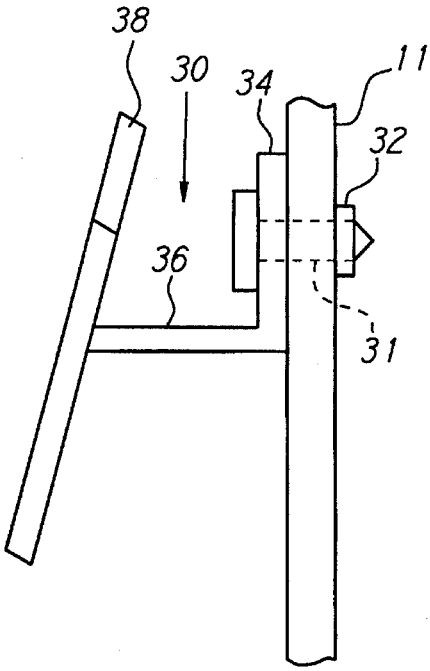
FIG. 8 is a plan view of a fan assembly.

Also in FIG. 3, and additionally in FIGS. 6 and 8, each of the fan assemblies 30 comprise a base 34, a fan blade 36, and a fence 38. Bases 34 are attached to disc 11 with bolts 31 (see FIG. 8) and lock nuts 32 (See FIG. 8). Each of the fan blades 36 is attached to disc 11 through one of the bases 34, and is preferably oriented approximately twelve degrees off radial with respect to axle 11A to encourage radial air flow. Fences 38 are attached to, and preferably angled approximately 7 degrees off normal with respect to attached fan blades 36. The fences 38 assist in holding air and light material to fan blades 36 and further encourage radial air flow. The preferred embodiment has two fan assemblies 30, but a fewer or greater number of fan assemblies 30 can also be accommodated.

Figure 4:
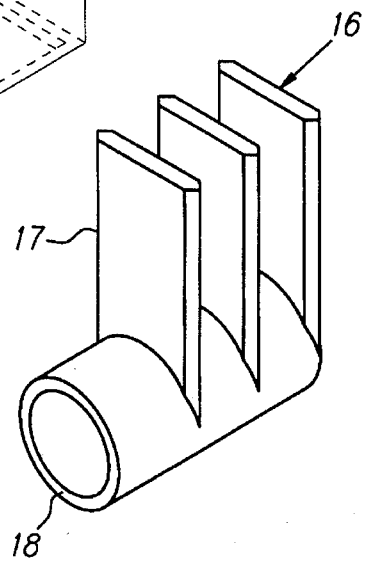
FIG. 4 is a perspective detail of a multi-blade flail of FIG. 3.

In FIG. 4, an exemplary multi-blade flail 16 has three blades 17, all of which are attached to a sleeve 18 to form a single unit which pivots freely about post 15. Blades 17 are substantially flat members, sharpened on at least the leading and trailing edges. In the preferred embodiment, blades 17 are positioned relative to one another on flail 16 such that one end of the sleeve 18 is relatively flush with one of the blades 17, and the other end of sleeve 18 is not flush with one of the blades 17. The flails 16 are then placed on the posts 15 such that blades 17 on adjacent flails 16 are staggered. The preferred staggered configuration is best seen at FIG. 6. Blades 17 need not, however, be positioned relative to one another on the flails 16 in this manner, and the blades 17 need not be staggered on disc 11.

The structure of flail 16 is not limited to that depicted in FIGS. 3–6. For example, flail 16 and can have two or more blades. A two-blade flail is preferred for reducing materials such as plastic bottles or aluminum cans into relatively large pieces, and a three-blade flail is preferred for reducing materials such as leaves, limbs and garden plants into relatively small pieces.

Figure 5:
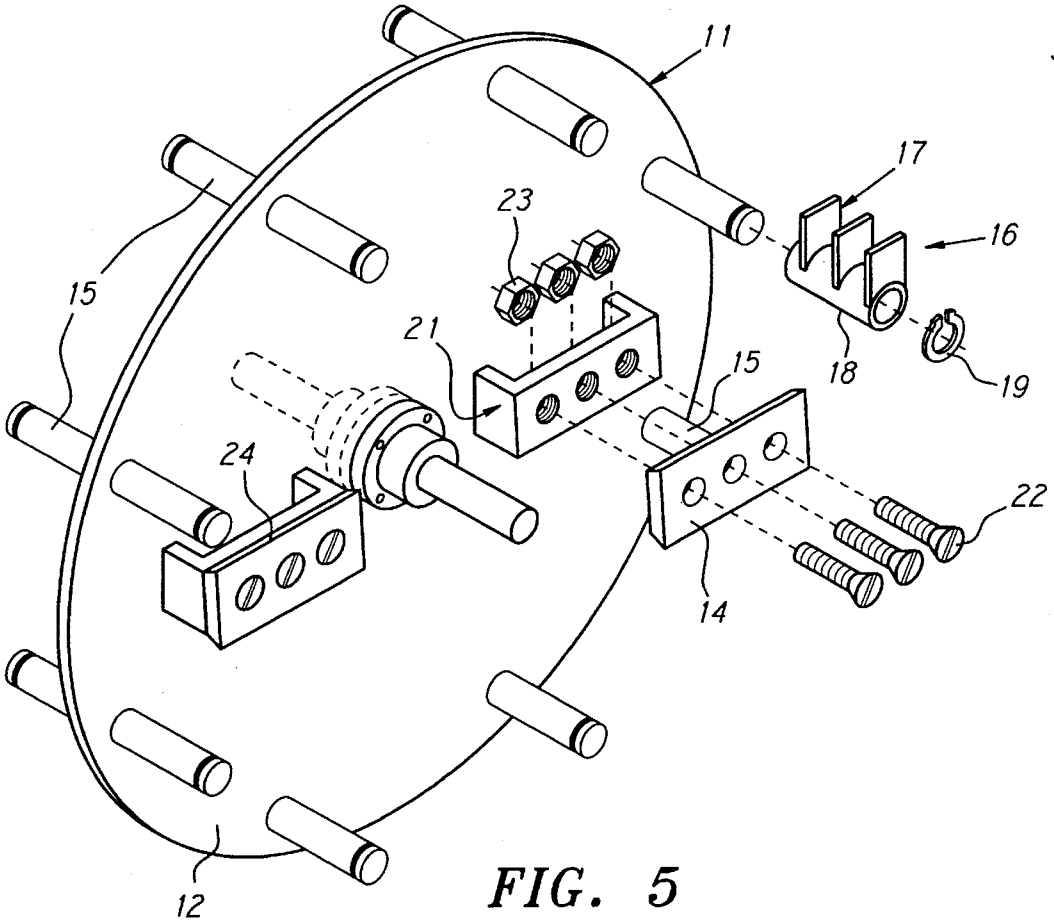
FIG. 5 is a partially exploded perspective view of the disc and attachments of FIG. 3.

In FIG. 5, knives 14 are positioned on the chipping side 12 of disc 11. Each of the knives 14 can have two cutting edges 24, and is therefore reversible. Knives 14 are preferably distanced away from the disc 11 by spacers 21, and are attached to both disc 11 and spacers 21 by nuts 22 and bolts 23. The knives 14 are thus considered to be positioned on a side of the disc 11 even though they may not physically be touching disc 11. By spacing the knife 14 away from disc 11, the knife angle can be changed or adjusted, and the knife 14 can be positioned closer to or farther away from the disc than shown. In the preferred embodiment, spacers 21 are dimensioned such that the cutting edges 24 are positioned about ¼ inch to ½ inch farther from the chipping side 12 of the disc 11 than the farthest of the blades 17. Such a configuration is preferable so that when material is fed into the device, the knives 14 have an opportunity to cut or chip into the material before it is struck by the flails 16. Experimentation has shown that the knives 14 can be mounted at least 3 inches away from disc 11. Instead of spacers 21 being used to distance the cutting edges of the knives 14 from the disc 11, the knives 14 themselves could be sized and dimensioned to distance the cutting edges 24 a desired distance from disc 11.

As shown in FIG. 5, a device according to the preferred embodiment is operable without having knife channels (see 4A in FIG. 1) through which chips pass from one side of the disc to the other. This improvement provides greater flexibility in using the device.

Also in FIG. 5, the preferred attachment of flails 16 to posts 15 is shown. Clip 19 prevents flail 16 from working its way off of post 15. Other means of attaching flails to disc 11 are possible, so long as flails 16 can rotate or pivot sufficiently to avoid breaking in the event that the blades 17 strike a rock or other relatively impervious object.

In FIG. 6 knives 14 are preferably affixed to the chipping side 12 of the disc 11, but not to the mulching side 13. In alternative configurations, the knives 14 could be attached to both sides 12, 13 of disc 11, or eliminated altogether. FIG. 6 shows flails 16 on both sides of disc 11, with all of the blades 17 pointing upwards for diagrammatic simplicity. In practice, flails 16 are preferably, but not necessarily present on both the chipping and mulching sides 12, 13 of disc 11, and blades 17 on different flails 16 would likely be pointing in different directions at any given time.

Figure 7:
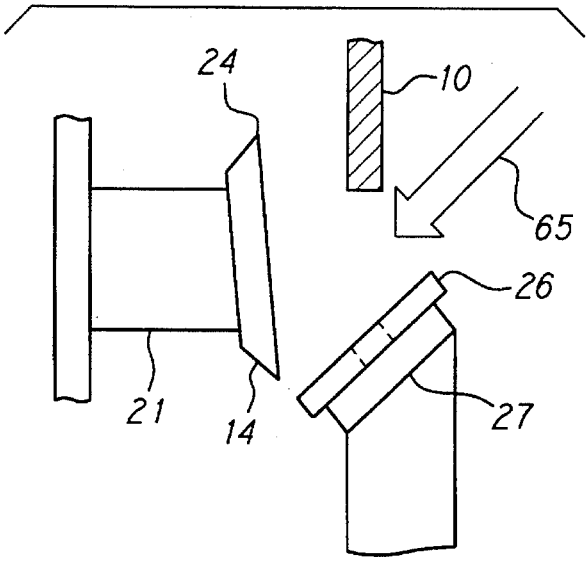
FIG. 7 is a diagrammatic side view of a partial cross section of a chipper/mulcher according to the present invention.

FIG. 7 shows the presently preferred orientation of the disc 11 and knife 14 with respect to a chipper feed path 65 through hopper 51 (see FIG. 3). The knife 14 is distanced from disc 11 by spacer 21 as discussed above, and is angled six to eight degrees off parallel with respect to disc 11. The chipper feed path 65 is approximately 45 degrees off parallel with respect to the disc 11. Bedknife 26 and bedknife mounting plate 27 are well known in the art.

Operation of the components is best seen in FIGS. 3 and 7. Disc 11 is contained with a housing 10, which is preferably of the split-shell design, and is made to rotate by a motor (not shown). The preferred embodiment uses two drop-feed hoppers 50 and 51 to admit material into housing 10. Hopper 50 leads to both the chipping side 12 and the mulching side 13 of disc 11, and hopper 51 leads to the chipping side 12 of disc 11. Optionally, other hopper configurations (not shown) can be used.

Leaves, twigs, aluminum cans, cardboard pieces, newspapers and other such materials (not shown) are fed along exemplary path 64 into hopper 50. As these materials travel along path 64 they strike flails 16 and possibly knives 4, and are reduced to smaller sized pieces (not shown). Relatively heavier materials such as thick plastics, branches, dimension lumber and telephone books (not shown) are fed along exemplary path 65 into hopper 51. This places them in contact with knives 4 where they are chipped, and subsequently in contact with flails 16 where they are further reduced to smaller sized pieces (not shown).

Although it is possible that the reduced pieces may exit the housing 10 along some path other than through screen 40, the presence or absence of screen 40, and the mesh size of the screen 40 largely determine the size of pieces in the finished product. The preferred screens 40 have meshes from ½ inch to 1 inch. After leaving the housing 10, the final product may be discharged through several means, including a bagging attachment (not shown) or a discharge chute mounted at top discharge opening 55. The preferred embodiment uses a simple bottom discharge opening 56.

Thus, a chipper/mulcher containing a multi-blade flail, a fan blade, a screen and a baffle has been disclosed. While specific embodiments and applications of this invention have been shown and described, it would be apparent to those skilled in the art that many more modifications are possible without departing from the inventive concepts herein. The invention, therefore, is not to be restricted except in the spirit of the appended claims.

What is claimed is:

1. A chipper/mulcher comprising:

a rotary disc having a first side;

a plurality of knives positioned on said first side for reducing materials fed toward said first side; and a flail comprising a plurality of substantially flat sharpened members spaced from one another and extending from a sleeve, said flail pivotally coupled to said first side.

2. The chipper/mulcher of claim 1 wherein said flail has at least three of said members and said sleeve is rotatably and reversibly mounted upon a post extending from said disc.

3. The chipper/mulcher of claim 2 further comprising a removable screen operatively positioned with respect to the flails to restrict output of reduced material to a maximum size.

4. The chipper/mulcher of claim 3 further comprising a first hopper for feeding material towards both said first and second sides of said disc, and a second hopper for feeding material towards said first side of said disc.

5. The chipper/mulcher of claim 2 wherein said disc has a second side, and a second flail is positioned on said second side of said disc.

6. The chipper/mulcher of claim 5 further comprising a plurality of fan blades positioned on said second side of said disc.

7. A chipper/mulcher comprising:

a housing having an interior;

a rotary disc positioned within said housing, said rotary disc operatively dividing said interior between a chipping side and a mulching side;

a knife and a first pivotable flail coupled to said disc on said chipping side;

a second pivotable flail coupled to said disc on said mulching side, said first and second flails each comprising a sleeve and a plurality of substantially flat sharpened members extending from said sleeve.

8. The chipper/mulcher of claim 7 wherein at least one of said sleeves is pivotally mounted on a post, said post extending from said disc.

9. The chipper/mulcher of claim 8 wherein at least one of said sleeves is reversible such that each of said members has at least two potentially sharpenable surfaces.

10. The chipper/mulcher of claim 7 wherein said flail is positioned radially outward on said disc relative to said knife.

11. The chipper/mulcher of claim 7 wherein a plurality of fan blades are attached to said disc on said mulching side.

12. The chipper/mulcher of claim 7 wherein:

at least one of said sleeves is pivotally mounted on a post;

said post extends from said disc;

at least one of said sleeves is reversible such that each of said members has at least two potentially sharpenable surfaces;

said flail is positioned radially outward on said disc relative to said knife; and a plurality of fan blades are attached to said disc on said mulching side.

13. The chipper/mulcher of claim 7 having at least two knives and at least four of said flails coupled to said chipping side, and at least four of said flails coupled to said shredding side.

14. In a chipper/mulcher having a frame, a housing attached to the frame, a motor attached to the frame, and a disc rotatably mounted to the frame and housed within the housing, said disc made to rotate by said motor, and said disc having attached thereto on at least one side thereof a plurality of knives and flails, the improvement comprising said flails having a plurality of sharpened blades fixedly attached to a hollow sleeve which is rotatably attached to a post, said post is fixedly attached to, and extends outwardly from, said disc, such that as said disc is rotated, said sleeves pivot about said posts, causing said flails also to pivot.

15. The chipper/mulcher of claim 14 wherein said flails are double edged, having a sharpenable knife-edge on both the leading and trailing edges thereof, and said flails are reversible on said posts.

16. The chipper/mulcher of claim 15 wherein said disc has another side, and further comprising a plurality of fan blades and flails on said other side.

17. In a chipper/mulcher having a frame, a housing having an interior attached to the frame, a motor attached to the frame, at least one opening in said housing for receiving reducible material, and a disc rotatably mounted to the frame and housed within the housing, said disc operatively dividing said interior between a chipping side and a mulching side and made to rotate about an axis of rotation by said motor, and said disc having positioned on at least one side thereof a plurality of knives and flails, the improvement comprising said flails having a plurality of sharpened blades, said knives positioned on the same side of the disc as at least one of said flails, and said knives extending a greater distance away from said disc than said same-side flails.

18. The chipper/mulcher of claim 17 wherein said knives extend approximately 1/16 to 1/8 inches beyond said same-side flails.

19. The chipper/mulcher of claim 17 further comprising a plurality of fan blades coupled to said disc.

20. The chipper/mulcher of claim 19 further comprising a fence attached to at least one of said fan blades.

21. The chipper/mulcher of claim 17 wherein said disc has two opposite sides, said flails are positioned on both of said sides, and a plurality of fan blades are positioned on said opposite side of said disc from said knives.

22. The chipper/mulcher of claim 17 further comprising a baffle depending from an inner surface of said housing, said baffle positioned such that rotation of said disc creates an air flow which tends to draw reducible material into said housing through said opening.

23. A chipper/mulcher comprising:

a rotary disc having a first side;

a plurality of knives positioned on said first side for reducing materials fed toward said first side; and a flail pivotally coupled to said first side, said flail comprising a sleeve and a plurality of substantially flat sharpened members fixedly mounted on and extending from said sleeve.

24. The chipper/mulcher of claim 23 wherein said flail has at least three of said members and said sleeve is rotatably and reversibly mounted upon a post extending from said disc.

25. The chipper/mulcher of claim 24 further comprising a removable screen operatively positioned with respect to the flails to restrict output of reduced material to a maximum size.

26. The chipper/mulcher of claim 25 further comprising a first hopper for feeding material towards both said first and second sides of said disc, and a second hopper for feeding material towards said first side of said disc.

27. The chipper/mulcher of claim 24 wherein said disc has a second side, and a second flail is positioned on said second side of said disc.

* * * * *